US007735170B1

(12) United States Patent
Emerson

(10) Patent No.: US 7,735,170 B1
(45) Date of Patent: Jun. 15, 2010

(54) DIAPER CHANGING PAD

(75) Inventor: Luke A. Emerson, Mendon, NY (US)

(73) Assignee: Parental Solutions, Inc., Mendon, NY (US)

( * ) Notice: Subject to any disclaimer, the term of this patent is extended or adjusted under 35 U.S.C. 154(b) by 433 days.

(21) Appl. No.: 11/434,299

(22) Filed: May 15, 2006

Related U.S. Application Data

(60) Provisional application No. 60/681,392, filed on May 16, 2005.

(51) Int. Cl.
*A47C 20/02* (2006.01)

(52) U.S. Cl. ..... 5/655; 5/603

(58) Field of Classification Search ..... 5/655, 5/603; 16/262, 265, 266, 268; 224/581, 224/577, 576, 575, 191, 186, 158, 153, 653; 108/166, 167, 171, 67, 69; 160/135
See application file for complete search history.

(56) References Cited

U.S. PATENT DOCUMENTS

| | | | | |
|---|---|---|---|---|
| 2,477,877 | A * | 8/1949 | Jeffrey | 24/265 B |
| 3,032,777 | A * | 5/1962 | Young | 4/240 |
| 4,455,711 | A * | 6/1984 | Anderson | 16/229 |
| 4,483,028 | A * | 11/1984 | Payne | 5/426 |
| 4,917,505 | A * | 4/1990 | Bullard et al. | 383/4 |
| 5,689,861 | A * | 11/1997 | Petignat | 24/265 WS |
| 6,272,704 | B1 * | 8/2001 | Cutler | 5/655 |
| 6,918,147 | B2 * | 7/2005 | Stackman et al. | 5/655 |
| 2005/0236002 | A1 | 10/2005 | Cooley | |

* cited by examiner

*Primary Examiner*—Peter M. Cuomo
*Assistant Examiner*—William Kelleher
(74) *Attorney, Agent, or Firm*—Karla M. Weyand

(57) ABSTRACT

The invention provides a stabilizing platform, a diaper changing pad which includes the stabilizing platform and a diaper changing bag.

13 Claims, 10 Drawing Sheets

DIAPER CHANGING PAD

The present application claims priority of U.S. Provisional Patent Application Ser. No. 60/681,392, filed on May 16, 2005, which is hereby incorporated by reference herein.

FIELD OF THE INVENTION

The subject invention is directed generally to a diaper changing pad and a stabilizing platform for a diaper changing pad.

BACKGROUND OF THE INVENTION

This invention offers an alternative to conventional diaper changing pads and tables. Traditional changing pads offer contour sides and a single safety strap to hold the baby in place, while other pads offer no safety apparatus at all. As children grow larger this can lead to various problems. Children tend to maneuver out of the safety strap possibly leading to an increase opportunity for injury, or they may flip over making it impossible to change the child quickly, effectively and hassle free.

When using traditional changing pads away from home, one finds that they can be very cumbersome. Many traditional pads do not fold, or if they do, the outside, or changing area, is exposed to the environment. Still other changing pads are convenient to travel with, but do not offer stability or safety. The present invention is directed to overcoming these deficiencies.

BRIEF DESCRIPTION OF THE DRAWINGS

These and other features and advantages of this invention will be evident from the following detailed description of preferred embodiments when read in conjunction with the accompanying drawings in which.

DETAILED DESCRIPTION OF THE INVENTION

The subject invention provides a device which includes a center section, a plurality of stabilizing sections which are foldably connected to the center section, a means for connecting the plurality of stabilizing sections with the center section and a plurality of openings in the center section configured to receive restraining means.

Another aspect of the invention relates to a stabilizing platform which includes a center section having a first and second edge along the length of the center section, two stabilizing sections where each of the two stabilizing sections includes a first cylindrical section, a second cylindrical section and a third cylindrical section. The center section includes two first openings along the first and second edges of the center section, the first openings configured to receive the stabilizing sections. The center section includes a plurality of second openings which are configured to receive the second and third cylindrical sections, where each of the second and third cylindrical sections of each of the two stabilizing sections protrude through one of the plurality of second openings which are configured to receive the second and third cylindrical sections, whereby each of the two stabilizing sections are foldably connected to the center section.

Another aspect of the invention relates to a diaper changing pad which includes a stabilizing platform and a covering for the stabilizing platform.

As used herein "stabilizing platform" is used to mean a device which, when a child is placed thereon and attached thereto, provides sufficient stability such that movement of the child, such as, for example, rolling over, is prevented, inhibited or hindered.

As used herein "stabilizing sections" is used to mean sections of the stabilizing platform that provide stability to the stabilizing platform.

Figure 1:
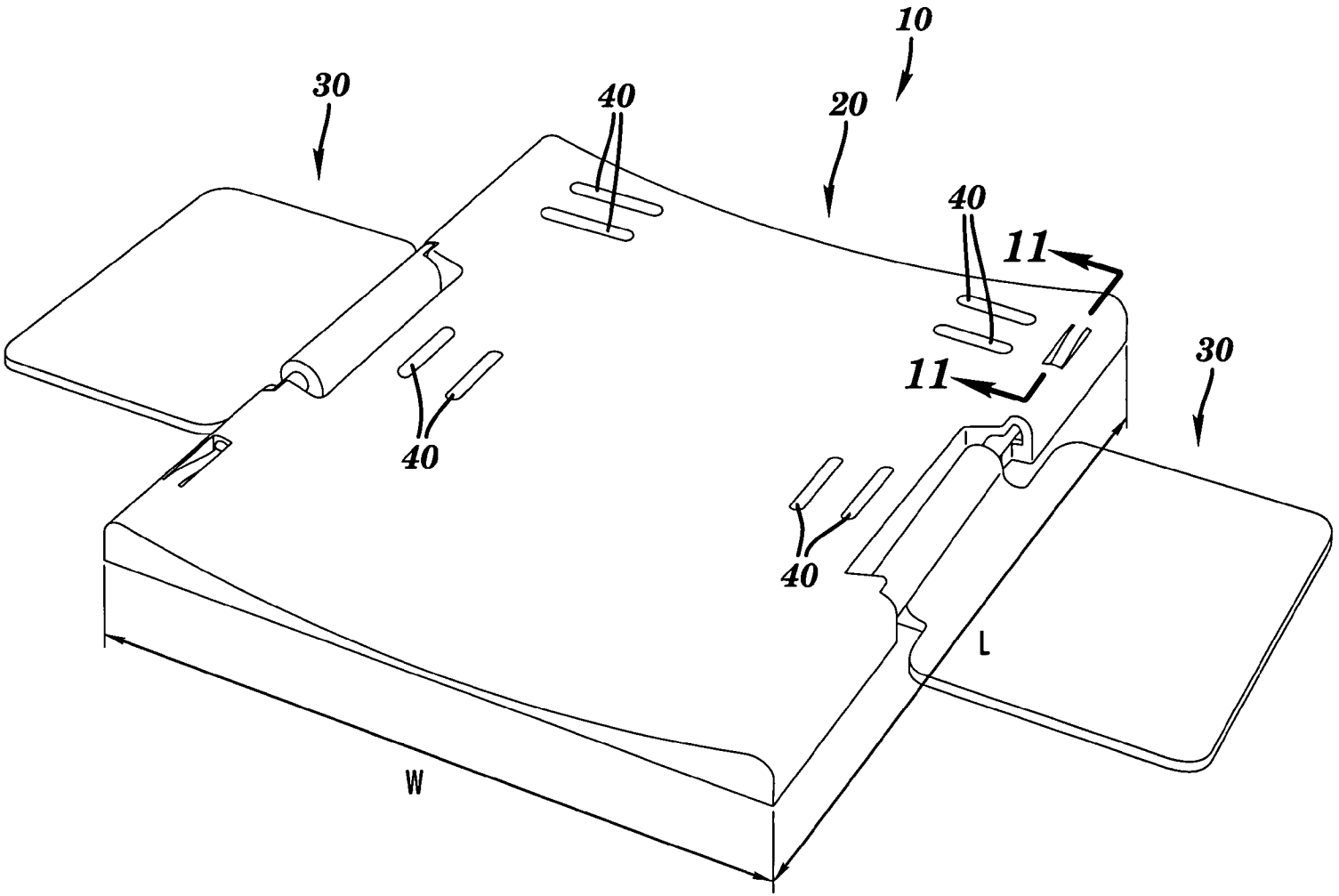
FIG. 1 illustrates a front view of a stabilizing platform showing a center section and two stabilizing sections folded open.
Figure 3:
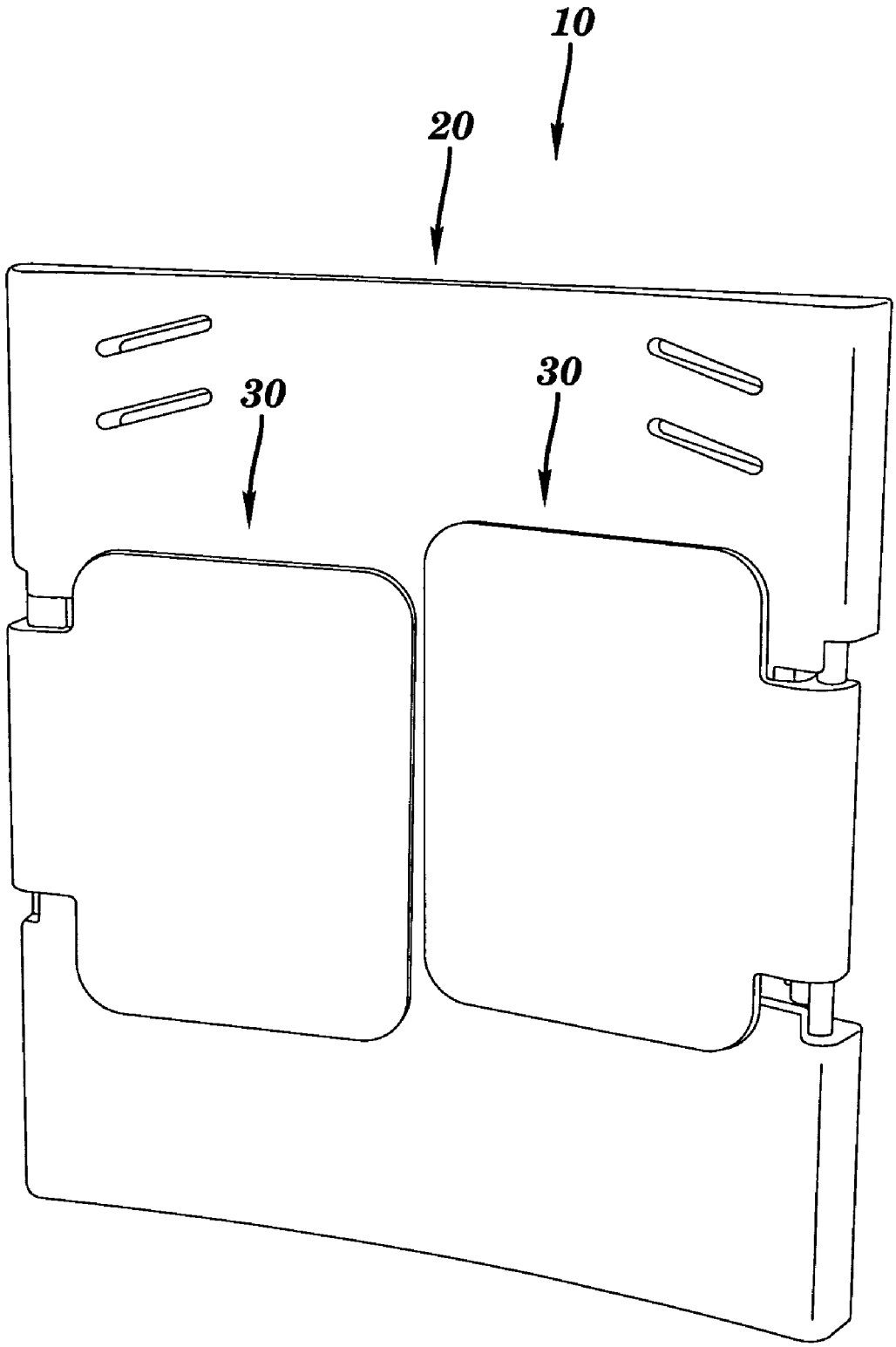
FIG. 3 illustrates a front view of a stabilizing platform having stabilizing sections folded closed.
Figure 9:
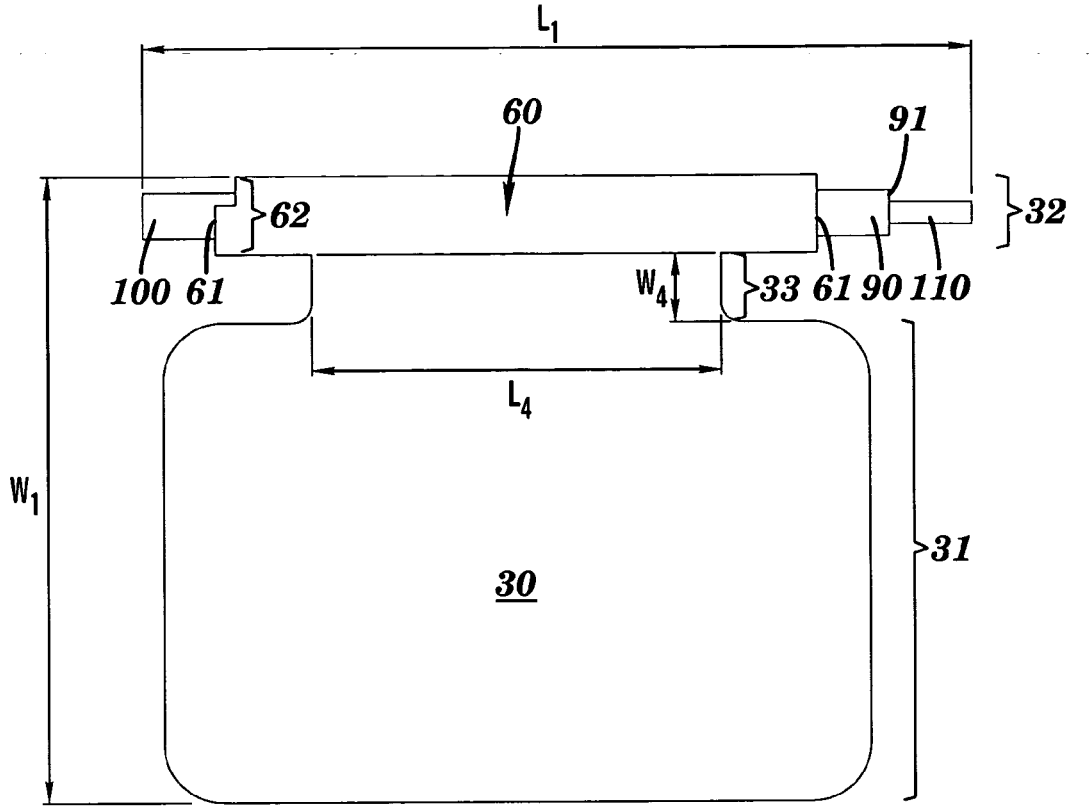
FIG. 9 illustrates a view of detached stabilizing sections.

In one embodiment of the present invention, as shown in FIG. 1, the stabilizing platform (10) of the present invention includes a center section (20) having an upper and lower surface and further having a length (L) and width (W) and one or more stabilizing sections (30). Stabilizing sections (30) have a length ($L_1$) and a width ($W_1$) as shown in FIG. 9. Center section (20) has a plurality of edges, for example, four edges, and has two outer edges (right and left) along the length and two outer edges (upper and lower) along the width. In the embodiment illustrated in FIG. 1, stabilizing platform (10) includes two stabilizing sections (30), however, in alternative embodiments more or fewer stabilizing sections (30) are included along the right and/or left edges along length (l) of center section (20). Alternatively, in other embodiments, for example, one or more stabilizing sections (30) are included along the upper and/or lower edges along width (w) of center section (20). Stabilizing platform (10) includes a plurality of openings (40), such as, for example, slots, which are configured to receive means (not shown) of restraining a child when the child is placed on the stabilizing platform. As shown in FIG. 1, stabilizing sections (30) are foldable, and can be positioned in the folded down position for stability. Stabilizing sections (30) in the folded up position are as shown in FIG. 3. In the folded up position, stabilizing platform (10) is easily transportable.

Figure 2:
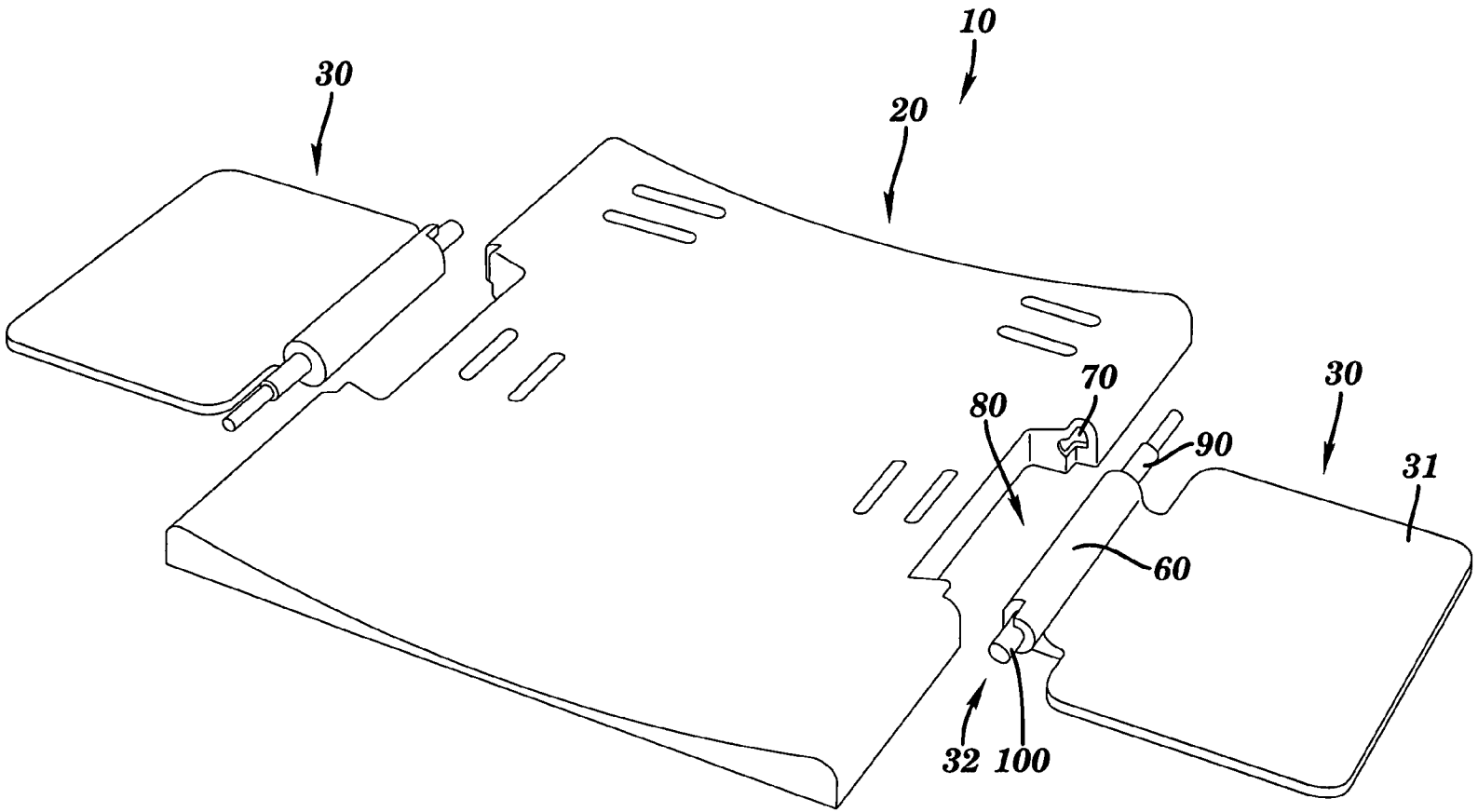
FIG. 2 illustrates a front view of a stabilizing platform having stabilizing sections detached.
Figure 4:
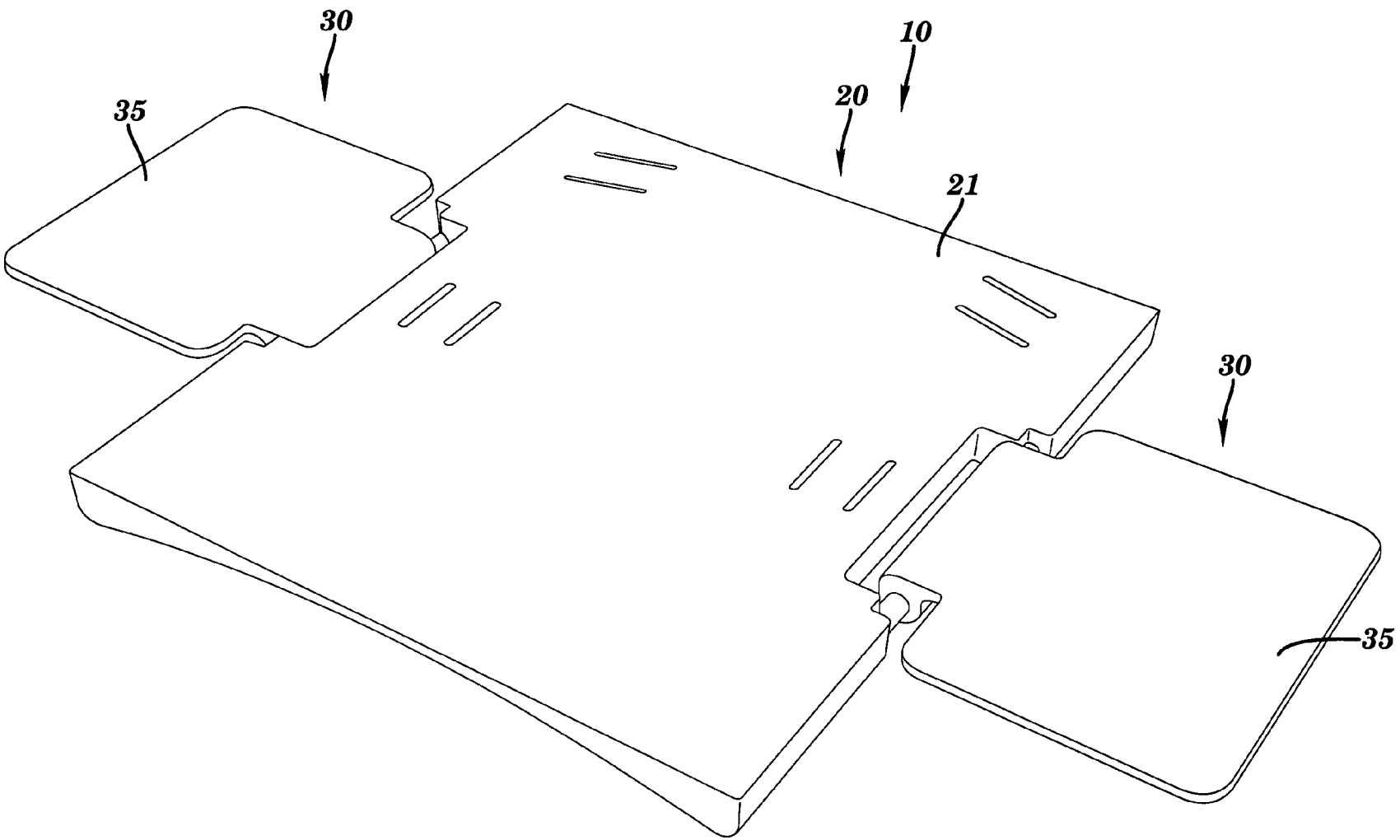
FIG. 4 illustrates a rear view of a stabilizing platform having stabilizing sections folded open.
Figure 5:
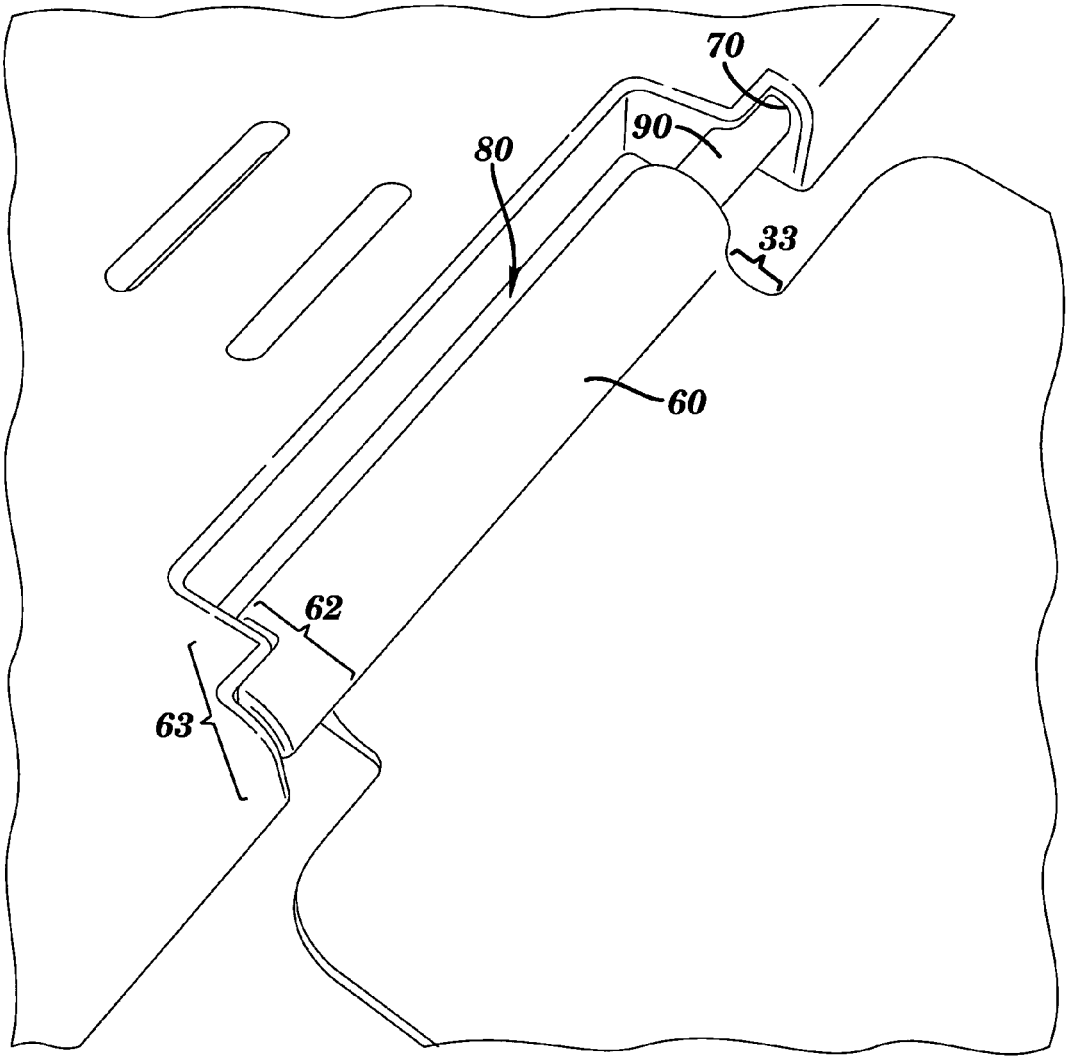
FIG. 5 illustrates a close up front view of means connecting stabilizing sections to a center section.
Figure 6:
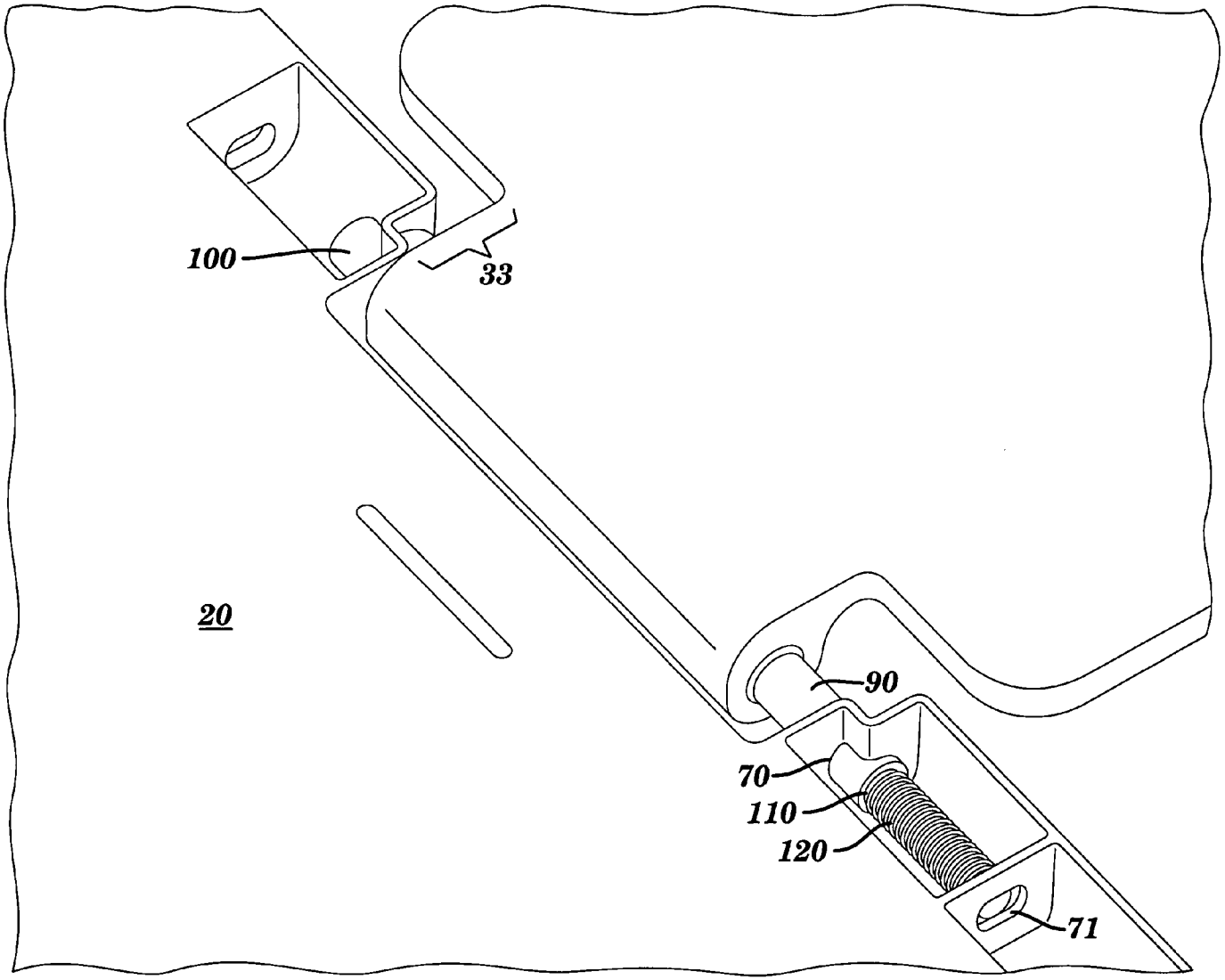
FIG. 6 illustrates a close up rear view of means connecting stabilizing sections to a center section.

One embodiment of means for connecting stabilizing sections (30) and center section (20) and positioning the stabilizing sections (30) from the folded up position to the folded down position are shown in FIGS. 1-6. FIG. 2 illustrates stabilizing sections (30) which are not connected to center section (20) in order to show the details of an embodiment of means for connecting. In one embodiment, as shown in FIGS. 2 and 5, stabilizing sections (30) include a substantially square or rectangular portion (31) and additionally include a substantially cylindrical protuberance section (32) which is configured to fit into space (80) and openings (70) of center section (10) in a manner that stabilizing sections (30) are foldably connected to center section (10). In one embodiment, as shown in FIGS. 5-6 and 9, stabilizing sections (30) include a transition section (33) between the substantially square or rectangular portion (31) and the substantially cylindrical protuberance section (32). In the embodiment as shown in FIGS. 2, 5, 6 and 9, means for connecting includes a first cylindrical section (60) having a length and a diameter where said length and diameter is configured to fit into a space (80) of center section (20), and second and third cylindrical sections (90 and 100) having diameters which are configured to fit the diameter of openings (70) of center section (10). First, second and third cylindrical sections (60, 90 and 100) are of the same diameter or of different diameters. Further, although in the embodiment of the invention shown in the Figures, means for connecting is made of cylindrical sections (60, 90 and 100), alternative shapes and configurations could be used. In addition, although in the embodiment of the invention shown in the Figures, means for connecting is shown as being permanently affixed to and integrally formed with stabilizing sections (30), means for connecting, in alternative embodiments, includes, for example, a hollow section connected to stabilizing sections (30) through which a connecting means, such as a rod, pin, screw or dowel, for example, is inserted and used to attach to center section (20). Alternative embodiments include, for example, a hinge mechanism for connecting stabilizing sections (30) to center section (20). Further, in alternative embodiments, means for connecting are connected to stabilizing sections (30) in a manner which is not permanently affixed, such as, for example, being removably connected by screws, tape, pins or other attachment methods known by those skilled in the art.

In an embodiment as shown in FIGS. 5-6 and 9, means for connecting includes a substantially cylindrical protuberance section (32) which has a first cylindrical section (60) having a length ($L_3$) and a diameter (D) and two ends (61). One end (61) of first cylindrical section (60) includes second cylindrical section (90) which extends longitudinally therefrom first cylindrical section (60) and has a diameter ($D_1$) and length ($L_5$). Although in the embodiment shown in the Figures diameter ($D_1$) of second cylindrical section (90) is smaller than that of the diameter (D) of first cylindrical section (60), in alternative embodiments, the diameter ($D_1$) of second cylindrical section (90) is smaller, larger, or the same as that of the diameter (D) of first cylindrical section (60). In one embodiment, as shown in FIGS. 6 and 9, second cylindrical section (90) includes an end (91) from which a forth cylindrical section (110) extends longitudinally therefrom. The diameter ($D_3$) of forth cylindrical section (110) is the same as or smaller than diameter ($D_1$) of second cylindrical section (90). As shown in FIG. 6, in one embodiment, forth cylindrical section (110) has an outer surface which is surrounded by a spring (120). End (61) of first cylindrical section (60) opposite second cylindrical section (90) includes third cylindrical section (100). Third cylindrical section (100) has a diameter ($D_4$) which smaller, larger, or the same as that of diameter (D) of first cylindrical section (60) and/or diameter ($D_1$) of second cylindrical section (90). Diameters ($D_1$) ($D_3$) and/or ($D_4$) are configured to fit into and protrude through openings (70) of center section (20) to foldably connect stabilizing sections (30) to center section (20). During the operation of folding stabilizing sections (30) from the folded down position into the folded up position, or vice versa, second, third and/or forth cylindrical sections (90, 100 and 110) rotate in openings (70) of center section (20).

Figure 10:
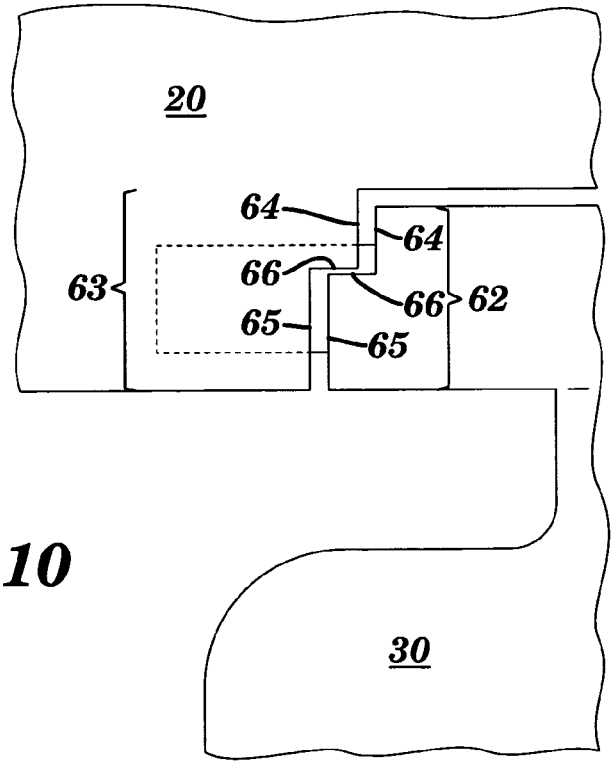
FIG. 10 illustrates a close up view of the notched portions of a center section and stabilizing sections as shown in FIG. 5.

In an embodiment of the invention as shown in FIGS. 5 and 9, one end (61) of first cylindrical section (60) includes a notched portion (62). Notched portion (62) is configured to correspond to and butt with a notched portion (63) of center section (20). The contact between notched portion (62) of first cylindrical section (60) and notched portion (63) of center section (20) prevents stabilizing sections (30) to be folded closed accidently once stabilizing sections (30) are fully opened. In one embodiment, as shown in FIG. 10, notched portions (62 and 63) include an upper horizontal surface (64), a lower horizontal surface (65) and a vertical surface (66).

In operating to fold stabilizing sections (30) from an open position (as shown in FIG. 1) into a closed position (as shown in FIG. 3), one grasps any portion of stabilizing section (30) and moves it in a plane generally along length (L) of center section (20) such that notched portions (62 and 63) are separated, i.e. the space between notched portions (62 and 63) becomes greater. The distance stabilizing section (30) is moved only needs to be enough for notched portion (62) of first cylindrical section (60) to clear notched portion (63) of center section (20). In one embodiment, stabilizing section (30) is moved such that lower horizontal surface (65) of stabilizing section (30) clears upper horizontal surface (64) of center section (20). Stabilizing section (30) is then folded into a closed position. Other stabilizing sections, if present, are folded closed in a similar manner. Conversely, in operating to fold stabilizing sections (30) from a closed position into an open position, one grasps stabilizing section (30) in a closed position (as shown in FIG. 3) and folds open stabilizing section (30) such that the upper surface of stabilizing section (30) is generally parallel with the upper surface of center section (20). Stabilizing section (30) is then moved in a plane generally along and parallel to the length (L) of center section (20) such that notched portion (62) of first cylindrical section (60) is in contact with notched portion (63) of center section (20). In one embodiment, vertical surfaces (66) of stabilizing section (30) and center section (20) are in contact such that stabilizing section (30) is in a position where it cannot be folded closed without first moving stabilizing section (30) in a direction generally along and parallel to length (L) of center section (20) such that notched portions (62 and 63) are no longer in contact.

In one embodiment of the invention, stabilizing sections (30) are removable from center section (20). For example, as shown in FIG. 6, stabilizing section (30) is moved in a plane generally horizontal and parallel to length (L) of center section (20) such that forth cylindrical section (110) passes through and protrudes from opening (71). Forth cylindrical section (110) is moved through opening (71) a distance such that third cylindrical section (100) passes through and clears opening (70). Stabilizing section (30) is then moved in a plane generally perpendicular to length (L) of center section (20) such that third cylindrical section (100) clears opening (80) of center section (20). Stabilizing section (30) is then moved in a direction such that forth cylindrical section (110) clears opening (70) and stabilizing section (30) is thereby disconnected from center section (20). Once stabilizing sections (30) have been removed, other stabilizing sections (30), such as those of different size and/or shape, can be inserted into center section (20).

Figure 11:
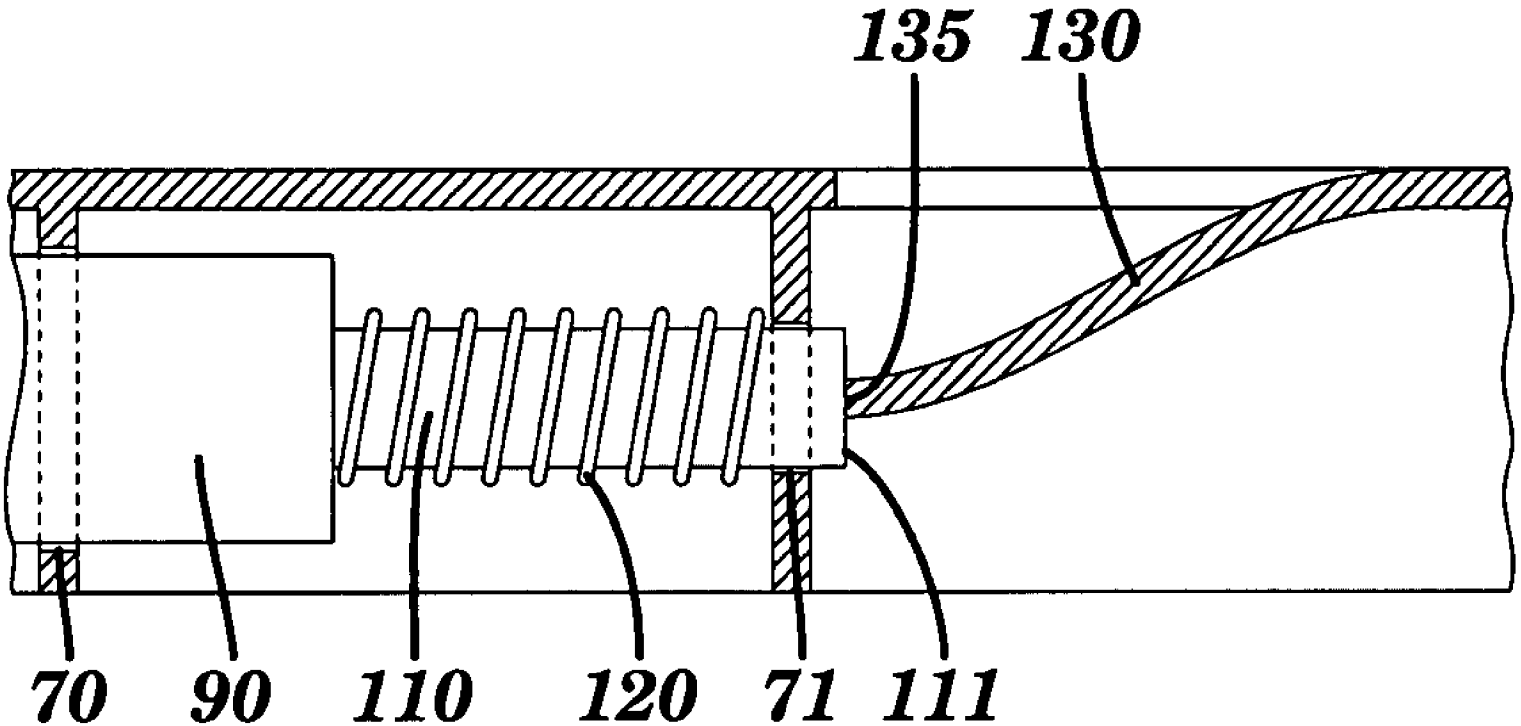
FIG. 11 illustrates a side cutaway view of a stopping mechanism of the present invention.

In one embodiment, a means which prevents stabilizing sections (30) from being removed accidentally from center section (20) is included. For example, as shown in FIG. 6, forth cylindrical section (110) could be held in place by means which prevent accidental movement of forth cylindrical section (110) through opening (71). Alternatively, opening (71) is configured such that forth cylindrical section (110) must be moved in a direction perpendicular to length (L) of center section (20) in order to pass through opening (71). In an alternative embodiment, as shown in FIG. 11, center section (20) includes a stopping mechanism (130) having a front edge (135) which is configured to stop the accidental movement of forth cylindrical section (120) in one direction along a path parallel to length (L) of center section (20). For example, stopping mechanism (130) extends from center section (20) such that it is in contact with an end (111) of forth cylindrical section (110), thereby preventing forth cylindrical section (110) from advancing in a direction past front edge (135) of stopping mechanism (130). Therefore, forth cylindrical section (110) is prevented from moving in a path parallel to length (L) of center section (20) in a direction towards front edge (135) of stopping mechanism (130) and away from opening (70). In order to allow stabilizing sections (30) to be removed from center section (20), stopping mechanism (130) is manually lifted or pushed in a direction perpendicular to a length (L) of center section (30) such that it no longer contacts end (111) of forth cylindrical section (110) and that forth cylindrical section (110), when moved in a direction generally horizontal and parallel to length (L) of center section (20) clears and passes under stopping mechanism (130). Stabilizing section (30) is then removed from center section (20) in a manner as described in the proceeding paragraph.

Figure 8A:
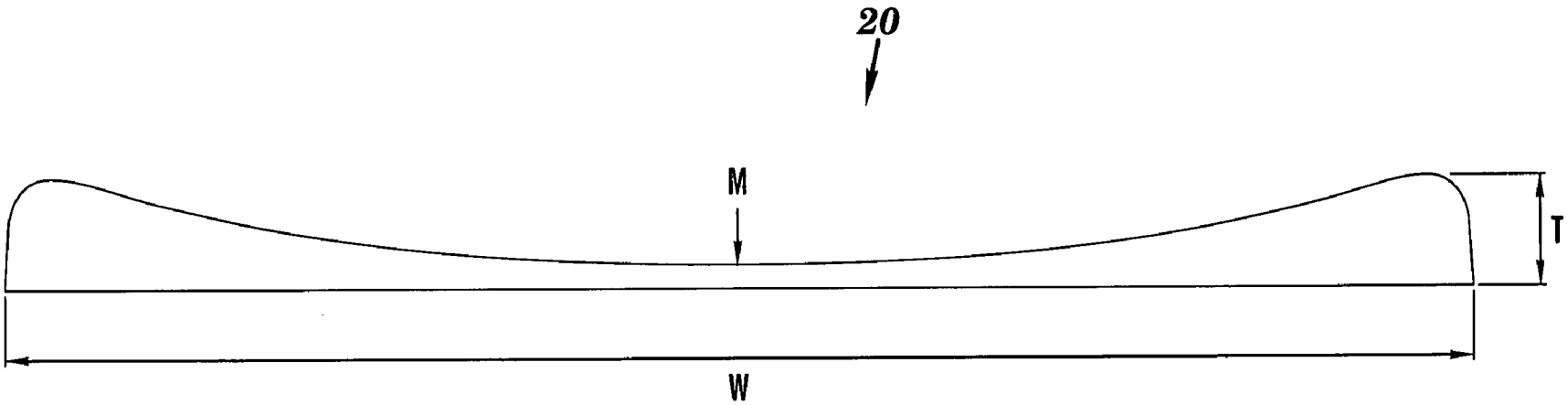
FIGS. 8 A and B illustrate a cross sectional view of a center section (A) and a stabilizing section (B) of a stabilizing platform.

As shown in FIGS. 1, 2 and 8A, in one embodiment, center section (20) is contoured. For example, as shown in FIG. 8A, center section (20) has a thickness (T) which gradually increases along the width (W) from the midpoint (M) of center section (20) to each of the outer right and left edges of center section (20). The contoured shape of center section (20) facilitates the ease and comfort of holding a child on center section (20) while changing diapers.

Stabilizing platform (10) is made of any material suitable for use as a changing pad, for example, wood, plastic or some other non-forgiving (i.e. sturdy) material. In one embodiment of the present invention, stabilizing platform (10) is a rigid plastic. Center section (20) and stabilizing sections (30) of stabilizing platform (10) are of the same materials or of different materials.

Figure 8B:
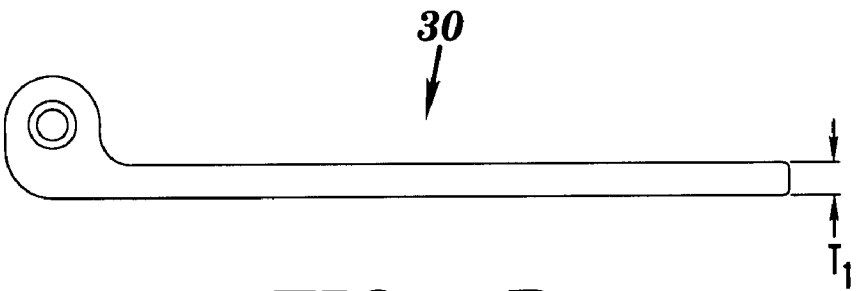

In one embodiment, center section (20) is generally square or generally rectangular. Center section (20) is from about 8 inches to about 18 inches in width (W) and from about 10 inches to about 20 inches in length (L). In one embodiment, center section (10) is from about 11 to about 14 inches in width (W) and from about 12 to about 16 inches in length (L). In one embodiment, center section is about 12 inches in width (W) and about 14 inches in length (L). Stabilizing sections (30) are of any suitable shape, such as, for example, being generally round, square, triangular or rectangular. Further, in one embodiment, stabilizing sections are configured to resemble wings, such as, for example, angel wings, butterfly wings or insect wings. In one embodiment, stabilizing sections (30) include a portion which is generally square or rectangular (31) and also further include a generally cylindrical protuberance section (32) on one side along a part of the length (L) of stabilizing section (30) (as shown in FIG. 9). In one embodiment, the generally square or generally rectangular portions (31) of stabilizing sections (30) are from about 3 inches to about 12 inches in width ($W_1$) and from about 3 inches to about 12 inches in length ($L_1$). In one embodiment, generally square or generally rectangular portions (31) of stabilizing sections (30) are from about 5 inches to about 8 inches in width ($W_1$) and from about 5 inches to about 8 inches in length ($L_1$). In one embodiment, generally square or generally rectangular portions (31) of stabilizing sections (30) are about 6 inches in width ($W_1$) and about 6-7 inches in length ($L_1$). As shown in FIGS. 8A and 8B, thickness (TO of generally square or generally rectangular portions (31) of stabilizing sections (30) is from about 0.2 to about 0.75 inches and thickness (T) of center section (20) is from about 0.25 inches at midpoint (M) to about 1 inch at its outer edges. In one embodiment, as shown in FIG. 9, transition section (33) of stabilizing sections (30) is from about 0.25 to about 1 inch in width ($W_4$) and from about 3 inches to about 5 inches in length ($L_4$). Substantially cylindrical protuberance section (32) has a length of about 5 to about 8 inches and a diameter of from about 0.25 to about 1 inches. Likewise, first, second, third and forth cylindrical sections (60, 90, 100, 110) have diameters of from about 0.25 to about 1 inches.

FIG. 4 illustrates a rear view of one embodiment of the present invention. The lower surface (21) of center section (20) and the lower surface (35) of stabilizing sections (30) are shown. Center section (20) and stabilizing sections (30), in one embodiment, are made of a rigid material, such as a plastic, which is formed into the shapes of stabilizing sections (30) and center section (20). In one embodiment, center section (20) and/or stabilizing sections (30) are formed of a solid material. In an alternative embodiment, although the upper surfaces of center section (20) and/or stabilizing sections (30) are formed of a solid material, the lower surfaces of center section (20) and/or stabilizing section (30) include formed plastic ridges extending therefrom the upper surfaces, the ridges running horizontally, vertically or both and being spaced apart a distance sufficient to give the stabilizing sections (30) and/or center section (20) additional stability.

Stabilizing platform (10) is included as part of a diaper changing pad and/or as part of a diaper changing pad in combination with a diaper changing bag.

Figure 7A:
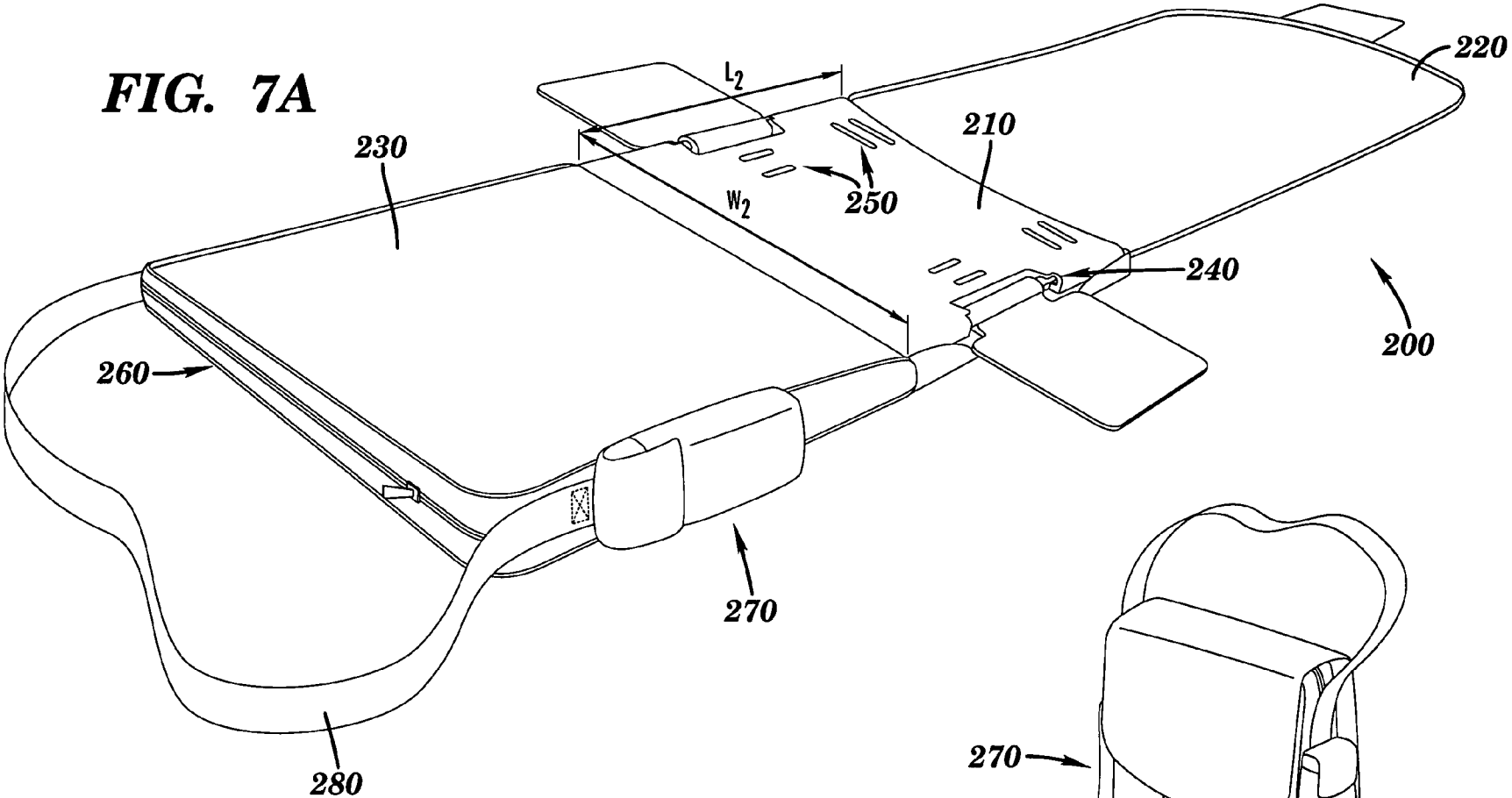
FIGS. 7 A and B illustrate a view of a diaper changing pad in an open position (A) and in a closed position (B).

FIG. 7A illustrates stabilizing platform (10) as part of a diaper changing pad (200). Diaper changing pad (200) includes a plurality of sections, such as, for example, three sections, a middle section (210), a first end section (220) and a second end section (230). Alternatively, in other embodiment, only one or two sections are included. As shown in FIG. 7A, middle section (210) is configured to surround and cover center section (20) of stabilizing platform (10). Middle section (210) has a length ($L_2$) and width ($W_2$) and is generally square or rectangular, being configured to cover the front and back surfaces of center section (20) of stabilizing platform (10). Middle section (210) has an upper surface and a lower surface, each having four sides. In one embodiment, each of the four sides of the upper surface of middle section (210) is connected directly (for example, sewn together) with each of the corresponding four sides of the lower surface of middle section (210). In an alternative embodiment, middle section includes portions which connect the upper surface and the lower surface of middle section (210). For example, a separate piece of material is used to connect each of the four sides of upper surface of middle section (210) to each of the four corresponding sides to the lower surface of middle section (210).

The upper surface of middle section (210) of diaper changing pad (200) covers the upper surface of center section (20) of stabilizing platform (10). The lower surface of middle section (210) of diaper changing pad (200) covers the lower surface of center section (20) of stabilizing platform (10). In one embodiment, openings (240) are configured along the length where upper surface of middle section (210) and lower surface of middle section (210) connect. In another embodiment, openings (240) are configured in the portions which connect the upper surface and the lower surface of middle section (210) of diaper changing pad (200). In each embodiment, openings (240) are configured such that stabilizing sections (30) of stabilizing platform (10) extend through the openings. In one embodiment, openings (240) are configured such that they are generally similar in dimension to the substantially cylindrical protuberance section (32) of stabilizing platform (10).

In one embodiment, the diaper changing pad of the present invention includes padding material, such as foam or other padding known in the art, between the upper surface of center section (20) of stabilizing platform (10) and the upper surface of middle section (210). Upper surface of middle section (210) includes a plurality of openings (250) which correspond to openings (40) in center section (20) of stabilizing platform (10).

Figure 7B:
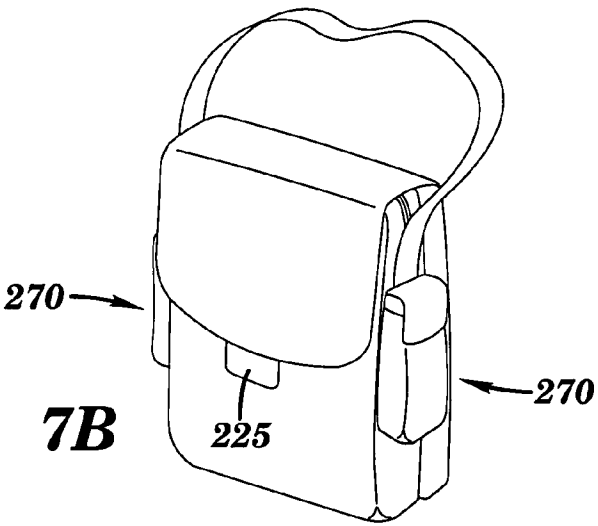

First and second end sections (220 and 230) are foldably connected to middle section (210). When folded closed, both first and second end sections (220 and 230) fold over middle section (210). A closure (225), such as, for example, velcro, snaps or clasps, are included to latch diaper changing pad (200), as shown in FIG. 7B.

In an additional embodiment, a diaper bag (260) is included as part of diaper changing pad (200). In one embodiment, diaper bag (260) may be removably connected to diaper changing pad (200) as shown in FIG. 7A, where diaper changing bag (260) is removable by unzipping the bag from the second end section (230) of diaper changing pad (200). In an alternative embodiment, diaper changing bag (260) is affixed in a permanent manner to diaper changing pad (200).

Diaper changing pad (200) is made of suitable material for ease of cleaning as is known in the art, such as polyester, duck cloth, cloth, vinyl, etc.

In one embodiment of diaper changing pad (200) of the invention, restraining means (such as means for securing a child) are included. In this embodiment, a restraining device, such as, for example, straps, ties, or a vest, are used. One end of the restraining device is wrapped around the child and secured and the other end passes through openings (250) of diaper changing pad (200) and openings (40) of center section (20) of stabilizing platform (10). Restraining means are connected with center section (20) in a fixed manner. For example, restraining means are attached to center section (20) of stabilizing platform (10). Methods of attaching one end of the restraining means to the stabilizing platform (10) include, for example, ends which are sewn together in such a manner that they cannot pass though openings (40) on center section of stabilizing platform (10). Methods of wrapping or securing the other end of restraining means around the child include attachment means known in the art, such as, for example, velcro closures, clasps, or buckles. As shown in FIGS. 1 and 7A, openings are included in the center section (20) of stabilizing platform (10) and middle section (210) such that restraining means, such as straps, can be wrapped around the child's shoulders, waist or both.

The diaper changing bag may additionally include various pockets (270) and/or a shoulder strap (280).

The present invention will allow children of all shapes and sizes to be safely secured in the proper diaper changing position. The present invention will decrease the amount of time and effort needed to change a child's diaper. Also, it will provide an increased amount of safety in comparison to conventional changing pads, because of the various stabilizing features. The present invention can also be folded into a small size rectangle for easy transport or storing at home.

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the claims which follow.

What is claimed is:

1. A device comprising: a center section; a plurality of stabilizing sections which are foldably connected to the center section means for connecting stabilizing sections with the center section wherein the stabilizing sections comprise the means for connecting stabilizing sections with the center section, wherein the means comprise a substantially cylindrical section which operates to foldably connect the plurality of stabilizing sections with the center section; and a plurality of openings in the center section configured to receive restraining means; wherein the substantially cylindrical section comprises a first cylindrical section, a second cylindrical section, and a third cylindrical section and wherein the center section comprises openings configured to receive the second and third cylindrical sections; wherein the first cylindrical section has an end which comprises a notched portion; wherein the center section comprises a notched portion which is configured to receive the notched portion of the end of the first cylindrical section; wherein the configuration of the notched portion of the end of the first cylindrical section and the notched portion of the center section operates to prevent the stabilizing sections to fold into a closed position.

2. A device according to claim 1, wherein the center section is contoured.

3. A device according to claim 2 wherein the second cylindrical section comprises a forth cylindrical section extending longitudinally from the second cylindrical section, wherein the forth cylindrical section is configured to receive a spring.

4. A device according to claim 3 wherein the center section comprises a plurality of openings which are configured to receive the generally cylindrical section of the plurality of stabilizing sections.

5. A device according to claim 4 wherein the device comprises two stabilizing sections.

6. A device according to claim 5 wherein the stabilizing sections are substantially square or rectangular.

7. A device according the claim 1 wherein the plurality of stabilizing sections comprises two stabilizing sections.

8. A diaper changing pad comprising a center section; a plurality of stabilizing sections which are foldably connected to the center section means for connecting stabilizing sections with the center section wherein the stabilizing sections comprise the means for connecting stabilizing sections with the center section, wherein the means comprise a substantially cylindrical section which operates to foldably connect the plurality of stabilizing sections with the center section; and a plurality of openings in the center section configured to receive restraining means; wherein the substantially cylindrical section comprises a first cylindrical section, a second cylindrical section, and a third cylindrical section and wherein the center section comprises openings configured to receive the second and third cylindrical sections; wherein the first cylindrical section has an end which comprises a notched portion; wherein the center section comprises a notched portion which is configured to receive the notched portion of the end of the first cylindrical section; wherein the configuration of the notched portion of the end of the first cylindrical section and the notched portion of the center section operates to prevent the stabilizing sections to fold into a closed position; and a plurality of foldable sections, wherein one of the plurality of foldable sections is configured to cover the device.

9. A diaper changing pad according to claim 8 further comprising restraining means.

10. A diaper changing pad according to claim 9 wherein the restraining means comprise straps.

11. A diaper changing pad according to claim 10 wherein one of the plurality of foldable sections comprises openings which are configured to receive the straps.

12. A diaper changing bag comprising: a shoulder strap, and a pad comprising a center section; a plurality of stabilizing sections which are foldably connected to the center section means for connecting stabilizing sections with the center section wherein the stabilizing sections comprise the means for connecting stabilizing sections with the center section, wherein the means comprise a substantially cylindrical section which operates to foldably connect the plurality of stabilizing sections with the center section; and a plurality of openings in the center section configured to receive restraining means; wherein the substantially cylindrical section comprises a first cylindrical section, a second cylindrical section, and a third cylindrical section and wherein the center section comprises openings configured to receive the second and third cylindrical sections; wherein the first cylindrical section has an end which comprises a notched portion; wherein the center section comprises a notched portion which is configured to receive the notched portion of the end of the first cylindrical section; wherein the configuration of the notched portion of the end of the first cylindrical section and the notched portion of the center section operates to prevent the stabilizing sections to fold into a closed position; and a plurality of foldable sections, wherein one of the plurality of foldable sections is configured to cover the device.

13. A stabilizing platform comprising: a center section having a first and second edge along the length of the center section; two stabilizing sections wherein each of the two stabilizing sections comprise a first cylindrical section, a second cylindrical section and a third cylindrical section; and wherein the center section comprises two first openings along the first and second edges of the center section, the first openings configured to receive the stabilizing sections, and further wherein the center section includes a plurality of second openings which are configured to receive the second and third cylindrical sections, wherein each of the second and third cylindrical sections of each of the two stabilizing sections protrude through one of the plurality of second openings which are configured to receive the second and third cylindrical sections, whereby each of the two stabilizing sections are foldably connected to the center section by the first, second and third cylindrical sections; wherein each of the two stabilizing sections include a first cylindrical section, wherein the first cylindrical section has an end having a notched portion and each of the two first openings along the first and second edges of the center section have a notched portion which corresponds to the notched portion of the first cylindrical section of each of the two stabilizing section, wherein the notched portion of the first cylindrical section and the notched portion of the center section operate to prevent each of the two stabilizing sections from being folded into a closed position.

* * * * *